US007669673B1

(12) United States Patent
Matthias et al.

(10) Patent No.: US 7,669,673 B1
(45) Date of Patent: Mar. 2, 2010

(54) AUGER HAVING INTERCHANGEABLE CUTTING HEADS AND METHOD OF USING THE SAME

(75) Inventors: Eric Matthias, Spencer, IA (US); Justin Reese, Laurens, IA (US)

(73) Assignee: Pengo Corporation, Laurens, IA (US)

( * ) Notice: Subject to any disclaimer, the term of this patent is extended or adjusted under 35 U.S.C. 154(b) by 13 days.

(21) Appl. No.: 11/768,071

(22) Filed: Jun. 25, 2007

(51) Int. Cl.
*E21B 10/44* (2006.01)
*E21B 17/22* (2006.01)

(52) U.S. Cl. ..... 175/323; 175/394; 175/310

(58) Field of Classification Search ..... 175/310, 175/323, 394, 412; 37/452, 465, 350, 453, 37/450, 455
See application file for complete search history.

(56) References Cited

U.S. PATENT DOCUMENTS

| | | | | | |
|---|---|---|---|---|---|
| 2,005,016 | A * | 6/1935 | Van Buskirk | ..... | 37/452 |
| 2,594,261 | A | 4/1952 | Henning | | |
| 2,731,237 | A | 1/1956 | Henning | | |
| 3,024,856 | A | 3/1962 | Henning | | |
| 3,388,488 | A * | 6/1968 | Duplessis | ..... | 37/452 |
| 3,763,942 | A * | 10/1973 | Levitt | ..... | 175/354 |
| 3,986,570 | A | 10/1976 | Stinson et al. | | |
| 4,202,416 | A * | 5/1980 | Blaschke et al. | ..... | 175/94 |
| 4,671,367 | A | 6/1987 | Brunsing et al. | | |
| 4,772,156 | A | 9/1988 | Craig | | |
| 4,968,101 | A | 11/1990 | Bossow | | |
| 5,366,031 | A | 11/1994 | Rickards | | |
| 5,426,875 | A | 6/1995 | Rickards | | |
| 5,427,191 | A | 6/1995 | Rickards | | |
| 5,433,033 | A | 7/1995 | Rickards | | |
| 5,476,149 | A | 12/1995 | Rickards | | |
| 5,657,827 | A | 8/1997 | Roth | | |
| 6,129,163 | A | 10/2000 | Hamilton et al. | | |
| 6,494,276 | B1 | 12/2002 | Hamilton et al. | | |
| 6,955,234 | B1 | 10/2005 | Mathews | | |
| 7,131,506 | B2 | 11/2006 | Hamilton et al. | | |
| 2001/0047887 | A1 * | 12/2001 | Wentworth et al. | ..... | 175/296 |
| 2005/0074299 | A1 * | 4/2005 | Nolan | ..... | 405/259.1 |

* cited by examiner

*Primary Examiner*—Jennifer H Gay
*Assistant Examiner*—Cathleen R Hutchins
(74) *Attorney, Agent, or Firm*—Ryan N. Carter

(57) ABSTRACT

An auger generally comprising a shaft having flighting which is helically wound around the shaft to convey spoil to the surface of the area being excavated. The shaft has a first end and a second end. The shaft first end is adapted to be combined with and rotated by a drilling machine. The shaft second end is adapted to be removably combined with a boring head and one or more drilling elements to bore through the ground. The invention comprises two interchangeable boring heads. A first boring head is adapted to drill through soft ground conditions such as dirt or clay and a second boring head adapted to drill through hard ground conditions such as rock.

12 Claims, 6 Drawing Sheets

AUGER HAVING INTERCHANGEABLE CUTTING HEADS AND METHOD OF USING THE SAME

BACKGROUND OF THE INVENTION

The invention relates to augers generally, and more particularly to an auger having a first and a second interchangeable end portion wherein the first end portion is adapted to bore though soft ground material and the second end portion is adapted to bore though hard ground material.

Augers are known and typically comprise a shaft with a boring head at one end. The boring head is adapted to cut through and generally loosen ground material ahead of the shaft. Spiral flighting is wound around the shaft for conveying the loosened ground material spoil from the boring head to the surface of the area being excavated. There are different kinds of augers for excavating different kinds of ground materials. One type of auger comprises a boring head and drilling elements (i.e. teeth or bits) adapted to bore through soft ground conditions such as dirt or clay. An example of this type of auger is disclosed in U.S. Pat. No. 5,476,149 (Rickards), which is hereby incorporated by reference. Although the type of auger disclosed in this patent works well for excavating soft ground conditions, it is not well suited to grind and bore through hard ground conditions because its boring head and drilling elements are not designed to bore through rock and other hard ground conditions. Further, even if the soft ground boring head were able to drill through rocky ground conditions, the auger may be damaged due to its lack of protection from the abrasive rocky spoils.

Another type of auger comprises a boring head and drilling elements adapted to excavate hard ground conditions such as rock. An example of this type of auger is disclosed in U.S. Pat. No. 5,427,191 (Rickards), which is hereby incorporated by reference. Although this type of auger works well for excavating rock, it is not well suited for excavating dirt because of the design of its boring head and drilling elements.

As discussed above, some types of augers are designed to excavate dirt and other types of augers are designed to excavate rock. The problem with having different augers dedicated to excavating different types of ground materials is that the user must purchase a different auger for excavating each different ground condition, which can be expensive for the user. Further, it can be difficult to predict which type of ground condition (i.e. dirt or rock) is going to be encountered during an excavating operation, therefore, the user must carry all augers with him/her at all times which can be inefficient and burdensome for the user.

There is therefore a need for a single auger having two interchangeable boring heads wherein the first boring head is adapted to bore through soft ground conditions such as dirt and the second boring head is adapted to bore through hard ground conditions such as rock.

SUMMARY OF THE INVENTION

The present invention is directed to an auger generally comprising a shaft having flighting which is helically wound around the shaft to convey spoil to the surface of the area being excavated. The shaft has a first end and a second end. The shaft first end is adapted to be combined with and rotated by a drilling machine. The shaft second end is adapted to be combined with a boring head and/or drilling elements. The invention comprises two interchangeable boring heads, both of which are adapted to be combined with the shaft second end. A first boring head is adapted to drill through soft ground conditions such as dirt or clay and a second boring head adapted to drill through hard ground conditions such as rock.

The present invention is beneficial over existing augers because it can be used to drill through both hard and soft ground conditions without needing to have two different augers (i.e. one dedicated for dirt conditions and one dedicated for rock conditions). Further, the auger of the present invention is more efficient than existing augers because the user only needs to transport and store one auger rather than two.

DETAILED DESCRIPTION OF THE INVENTION

Figure 1:
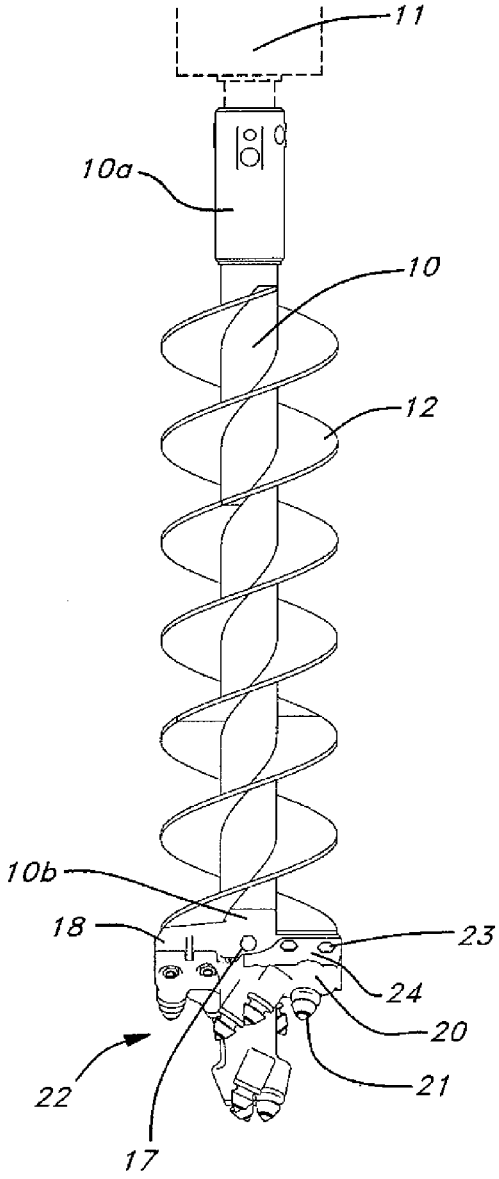
FIG. 1 is a side view of an embodiment of the invention showing the rock head combined with the auger.
Figure 2:
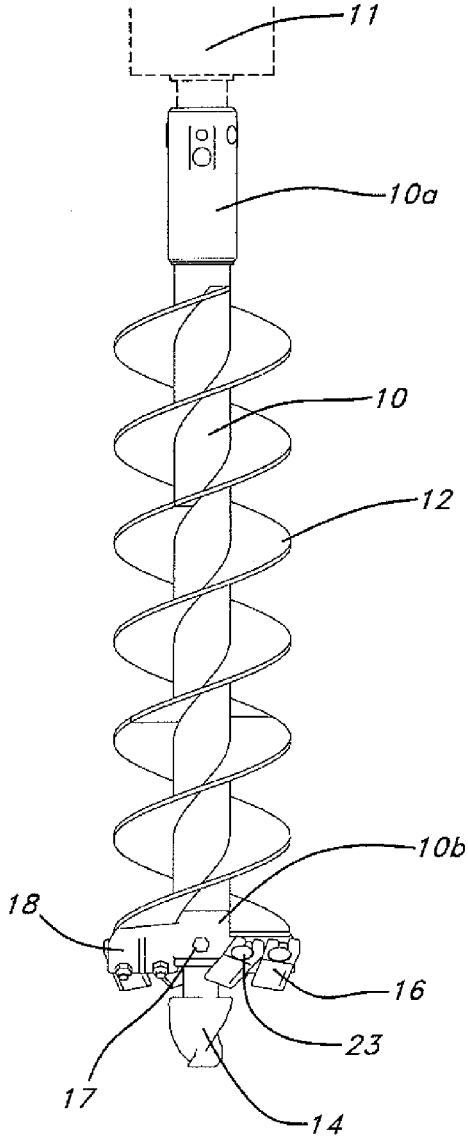
FIG. 2 is a side view of an embodiment of the invention showing the dirt head combined with the auger.

Referring to the drawings in detail, wherein like numerals indicate like elements, FIGS. 1 and 2 show an auger shaft 10 having a first end 10*a* and a second end 10*b*. The shaft first end 10*a* is adapted to be combined with and rotated by any suitable drilling machine 11. The shaft second end 10*b* comprises a means for removably combining with a boring head 14, 22 and/or drilling elements 16 or 21. The boring head 14, 22 and drilling elements 16, 21 are adapted to loosen the ground ahead of the shaft 10 and cut clearance through the ground for the auger shaft 10. The shaft 10 comprises flighting 12 which is helically wound around auger shaft 10 to convey the loosened ground spoil to the surface of the area being excavated. The shaft 10 second end comprises an attachment plate 18 that is adapted to help secure the boring means (i.e. boring head 14, 22 and/or drilling elements 16, 21) to the shaft 10. In some embodiments, the attachment plate 18 is permanently combined with the shaft 10 by welding or other suitable means. It should be noted that although the invention is described herein primarily as having boring means for boring through dirt or rock, other suitable boring means may be used to allow the auger to efficiently excavate other kinds of materials.

Figure 5:
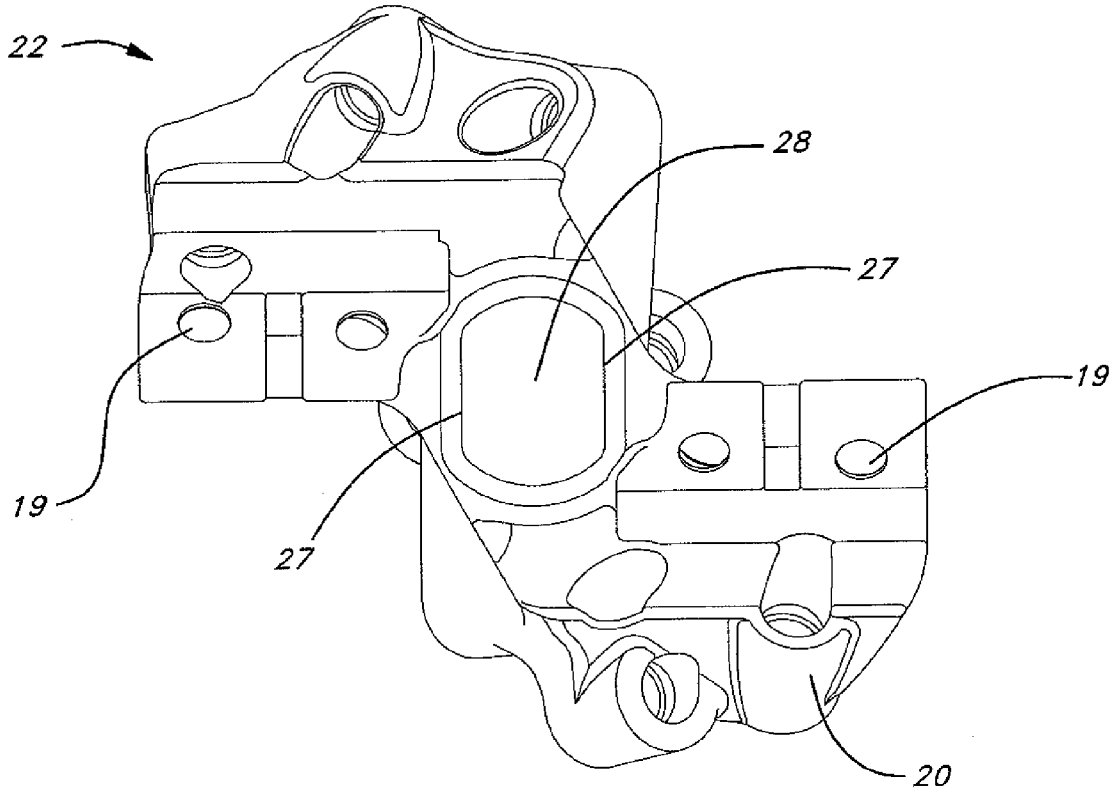
FIG. 5 is a top view of an embodiment of the invention showing the stem and mounting features of the rock head.
Figure 7:
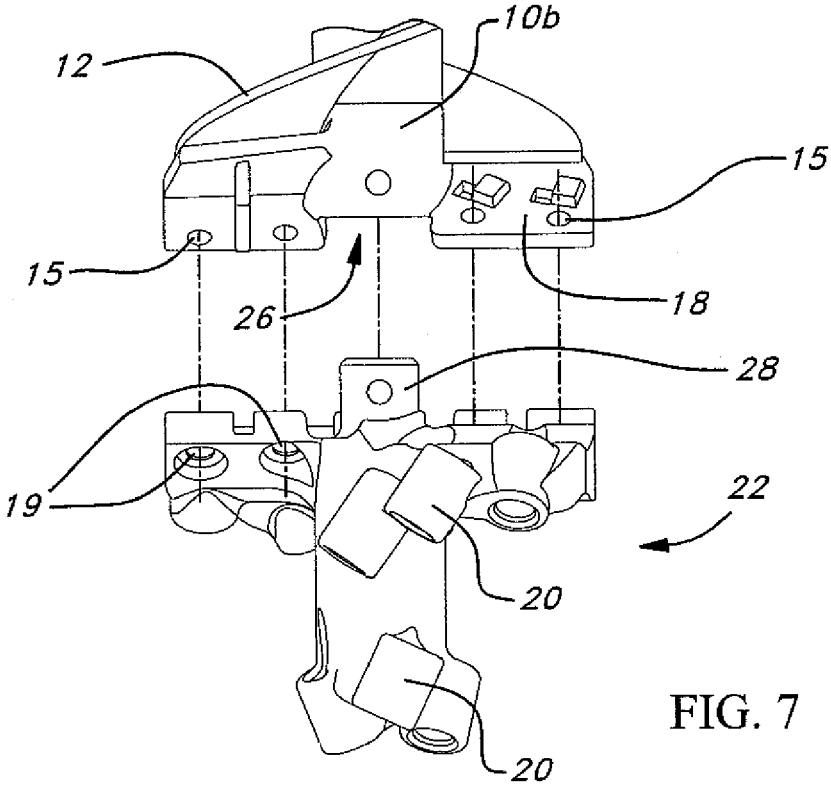
FIG. 7 is a side view of an embodiment of the invention showing how the rock head is adapted to combine with the auger.

The invention comprises an auger having at least two interchangeable boring heads wherein a first boring head 14 is adapted to bore through soft ground material such as dirt or clay and a second boring head 22 is adapted to bore through hard ground material such as rock. FIG. 1 shows the auger combined with the hard ground material (rock) boring head 22. The rock boring head 22 is preferably formed as one piece with the drilling element holders 20 formed in the head 22 as shown in FIGS. 5 and 7. The drilling element holders 20 comprise openings adapted to receive drilling elements 21, such as teeth or bits (FIG. 1). Examples of drilling elements 21 and drilling element holders 20 are generally disclosed in U.S. Pat. No. 5,427,191 (Rickards), which is hereby incorporated by reference. The rock boring head 22 primarily serves two main purposes. First, it allows the auger to bore through hard ground material such as rock. Second, it helps to cover and protect the attachment plate 18 from being damaged by the abrasive rocky spoils. As noted above, in some embodiments the attachment plate 18 is permanently combined with the auger, therefore, it is important to protect it from damage to prolong the life of the auger.

FIG. 2 shows the auger combined with the soft ground material (dirt) boring head 14. An example of this type of boring head 14 is generally disclosed in U.S. Pat. No. 5,476,149 (Rickards), which is hereby incorporated by reference. As seen in FIG. 2, in one embodiment the auger is combined with drilling elements 16 which are removably secured to the auger's attachment plate 18. Examples of these types of drilling elements 16 are generally disclosed in U.S. Pat. No. 5,433,033 (Rickards), which is hereby incorporated by reference. In alternate embodiments, the drilling elements 16 may be combined directly with the dirt head 14.

Figure 4:
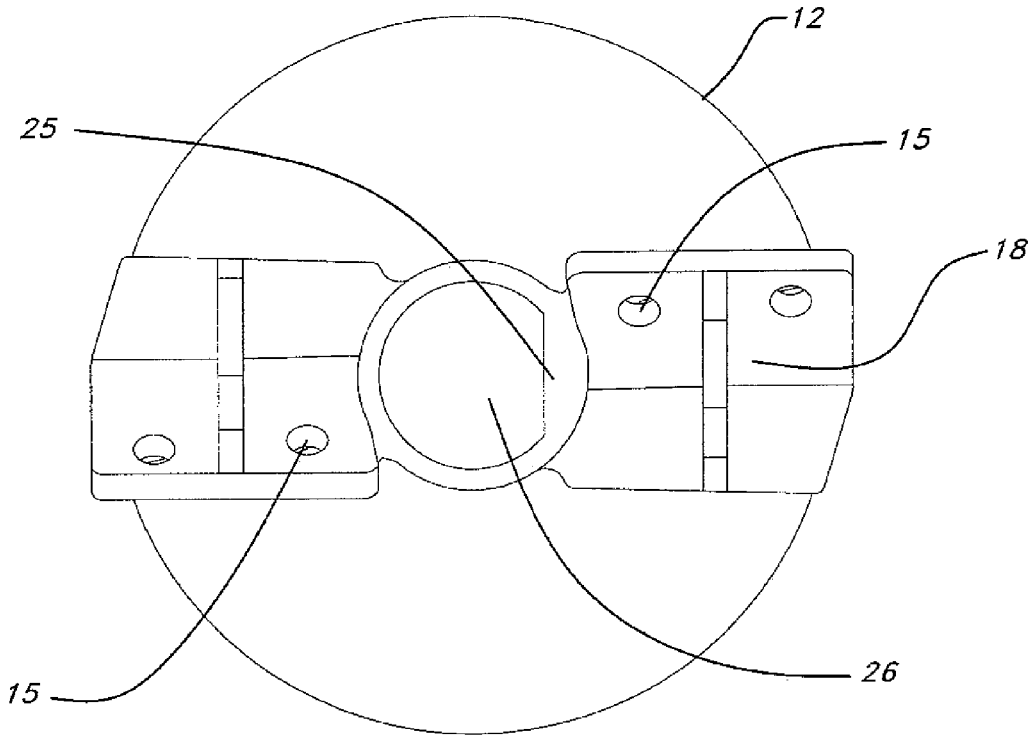
FIG. 4 is a bottom view of an embodiment of the invention showing the opening adapted to receive the dirt head or the rock head.
Figure 9:
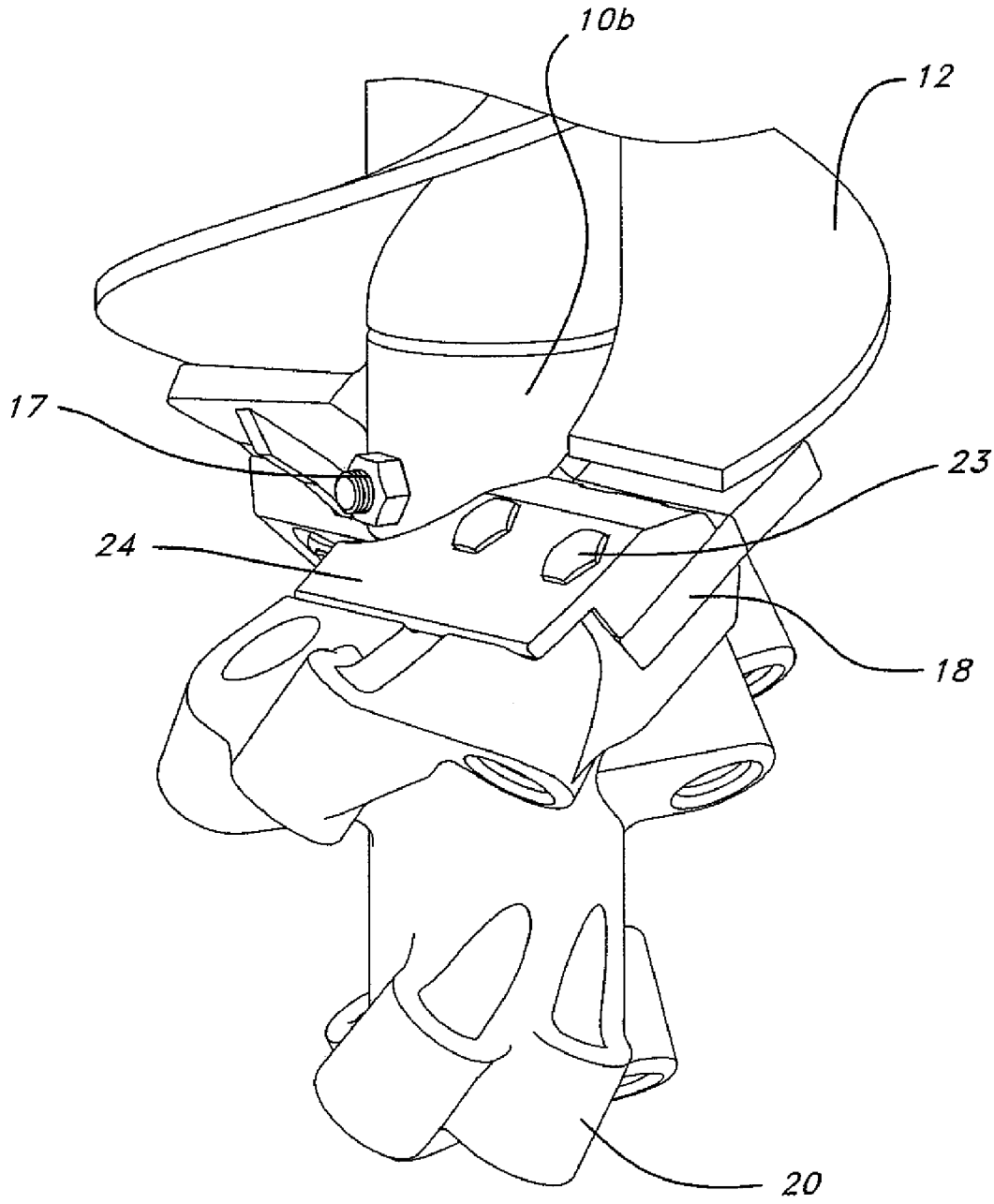
FIG. 9 is a side view of an embodiment of the invention showing the wear cap combined with the auger.

FIGS. 4 and 7 show an opening 26 in the shaft 10 that is adapted to receive a portion of the heads 14, 22 to secure the heads 14, 22 thereto. FIGS. 5 and 7 show the stem 28 portion of the rock head 22 that is received by the opening 26 in the shaft 10. It should be noted that although it is not shown, the dirt head 14 comprises a stem that is similar to the stem 28 shown in FIG. 5 for the rock head 22. In the embodiments shown in FIGS. 1 and 2, after the stem portion 28 of the heads 14, 22 are inserted into the opening 26 in the shaft 10, a bolt 17 is used to secure the heads 14, 22 to the shaft 10, however any other suitable connecting means may be used as long as the connecting means allows the heads 14, 22 to be selectively removed from the shaft 10. As seen in FIGS. 5 and 7, the rock head 22 may also comprise openings 19 which align with openings 15 on the attachment plate 18. As shown in FIG. 9, the openings 19 and 15 are adapted to receive bolts 23 to help secure and align the rock head 22 with the auger.

Figure 3:
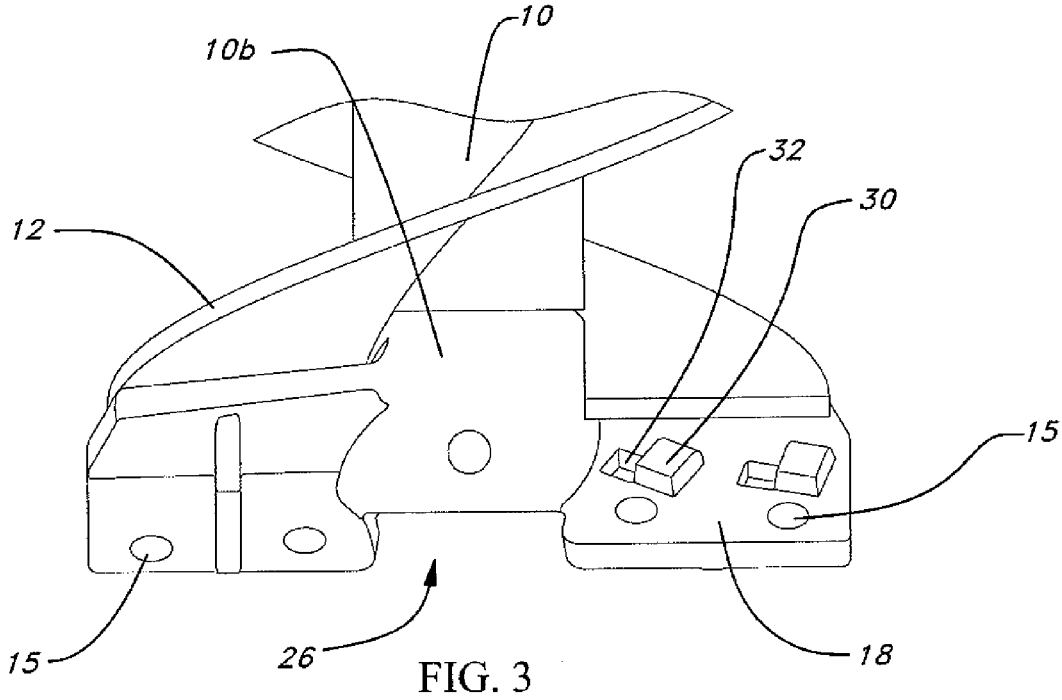
FIG. 3 is a side view of an embodiment of the invention showing the attachment plate wherein the auger is not combined with either the dirt head or the rock head.

FIGS. 3 and 4 show the shaft second end 10*b* wherein the auger is not combined with either the dirt head 14 or the rock head 22. With the heads 14, 22 and drilling elements 16, 21 removed, FIGS. 3 and 4 clearly show the attachment plate 18 and the opening 26 in the shaft second end 10*b*. The attachment plate 18 is adapted to combine with the dirt drilling elements 16, rock head 22, and/or wear caps 24 as described herein. In the embodiment shown in FIG. 2, the dirt drilling elements 16 are secured to the attachment plate 18 by bolts 23 received by openings 15 in the attachment plate 18, however any other suitable connecting means may be used. As shown in FIG. 3, the attachment plate 18 may comprise protrusions 30 and recesses 32 to help secure and align the drilling elements 16, rock head 22, and/or wear caps 24.

In one embodiment shown in FIG. 4, the opening 26 comprises a flat portion 25 which acts as a key to prevent the heads 14, 22 from spinning independently from the shaft's 10 rotation. As shown in FIG. 5, the stem portion 28 comprises at least one flat surface 27 adapted to interfere with the opening's 26 flat portion 25. In the embodiment shown in FIG. 5, the stem 28 comprises two flat portions 27 adapted to interfere with the opening's 26 flat portion 25 so the head 14, 22 can be inserted into the opening 26 in either of two orientations.

Figure 6:
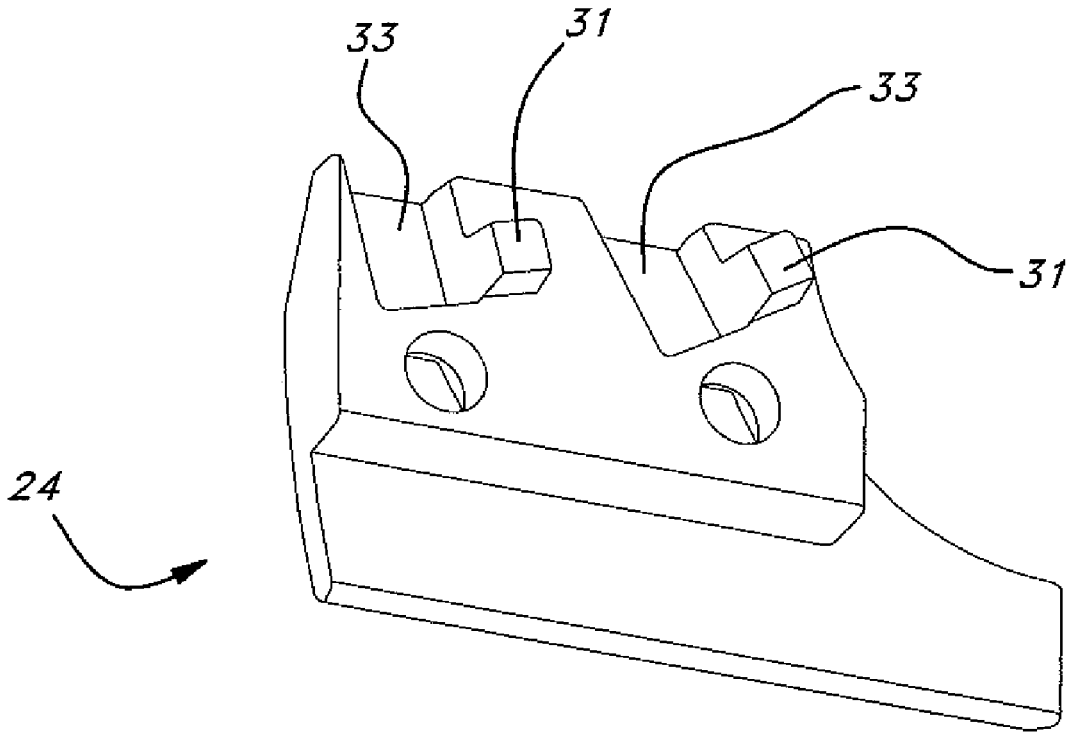
FIG. 6 is a perspective view of an embodiment of a wear cap showing the recesses and protrusions.
Figure 8:
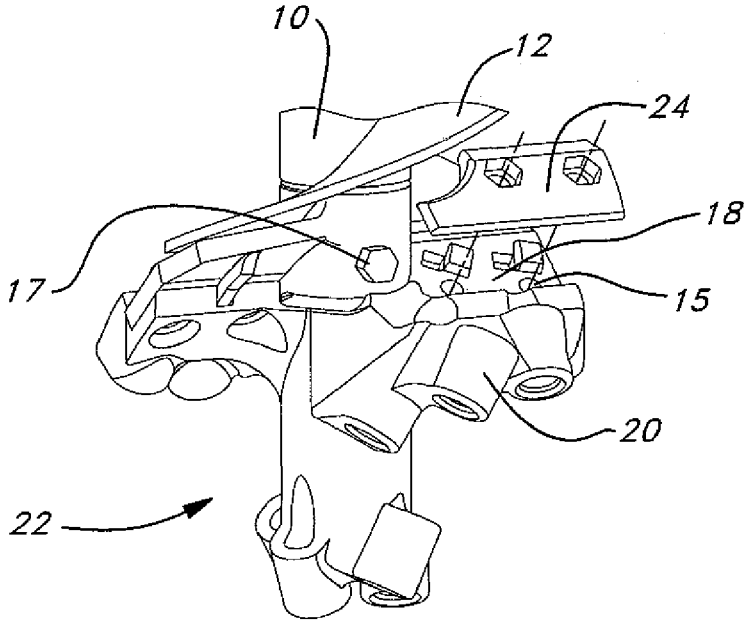
FIG. 8 is a perspective view of an embodiment of the invention showing how the wear cap is adapted to combine with the auger.

As described above, the attachment plate 18 helps ensure the attachment and alignment of the boring heads 14, 22 with the auger. As noted above, in some embodiments the attachment plate 18 is permanently combined with the auger, therefore, it is important that the attachment plate 18 is not damaged during an excavating operation. Typically, when excavating soft ground conditions, there is low risk of damaging the attachment plate 18. However, when excavating hard ground conditions, the risk of damaging or causing excessive wear to the attachment plate 18 is higher. In some embodiments of the present invention, the rock head 22 is used to help protect the attachment plate 18 from damage. This is shown in FIGS. 1 and 9 wherein the rock head 22 covers the bottom surface of the attachment plate 18 to help protect the attachment plate 18 from damage that may otherwise be caused by the abrasive rocky spoils. In addition to the rock head 22, other embodiments use wear caps 24 to help protect the top surface of the attachment plate 18 as the rocky spoils moves from the rock head 22 toward the flighting 12. The wear caps 24 are shown in FIGS. 8 and 9. The wear caps 24 may be combined with the attachment plates 18 or rock head 22 by any suitable means. In the embodiment shown in FIGS. 8 and 9, the wear caps 24 are bolted to the attachment plate 18 to sandwich the attachment plate 18 between the wear caps 24 and the rock head 22. In this manner, the wear caps 24 protect the top surface of the attachment plate 18 and a portion of the rock head 22 from being damaged by the abrasive rocky spoils as well as help to secure and fasten the rock head 22 to the auger. In some embodiments, the wear caps 24 may comprise recesses 33 and protrusions 31 (FIG. 6) that mate with the recesses 32 and protrusions 30 on the attachment plate 18 (FIG. 3). This mating helps keep the wear caps 24 aligned during operation. If the wear caps 24 become damaged or worn out, they can be replaced at a fraction of the cost of replacing the rock head 22 or having to remove the attachment plate 18 by destructive means, such as torch cutting.

In use, the auger may be used to bore through rock or dirt conditions depending on which of the two heads 14, 22 is attached to the shaft 10. To change from having the dirt head 14 and dirt drilling elements 16 combined with the shaft 10 to having the rock head 22 combined with the shaft 10, the user first must remove the dirt head 14 from the shaft 10. In one embodiment, this is done by removing the bolt 17 and then removing the dirt head 14 from opening 26 in shaft 10. The user must also remove the dirt drilling elements 16 from the attachment plate 18 by removing the bolts 23 securing the drilling elements 16 to the attachment plate 18. After removing the dirt head 14 and drilling elements 16, the auger second end 10*b* looks like it does in FIG. 3. Next, the user inserts the stem 28 of the rock head 22 into the opening 26 in the shaft 10 and secures the rock head 22 to the shaft 10 with bolt 17. Wear caps 24 may be placed over the attachment plate 18 and rock head 22 and secured in place with bolts 23 as shown in FIG. 9. If the drilling elements are not already combined with the rock head 22, the rock drilling elements 21 must be secured into the holders 20 on the rock head 22. To convert the rock boring auger back into a dirt boring auger, the process is simply reversed.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. An auger assembly for use with a drilling machine for excavating a ground surface, said auger assembly comprising:

a shaft having a first end and a second end, wherein the shaft first end is adapted to be combined with and rotated by a drilling machine;

wherein the shaft second end is removably combined with a dirt boring head for drilling through soft ground conditions and a rock boring head for drilling through hard ground conditions;

wherein the dirt boring head comprises a pilot bit and a plurality of generally flat drilling elements all independently removably combined with the shaft second end;

wherein the rock boring head is one integral member removably combined with the shaft second end, wherein the member comprises a plurality of drilling elements;

flighting which is helically wound around the shaft to convey spoil to the surface;

an attachment plate combined with the shaft second end; and a removable wear cap combined with the attachment plate to help protect the attachment plate from abrasive spoils and help secure the rock boring head to the shaft second end.

2. The auger of claim 1 wherein the shaft second end comprises an opening for receiving a portion of either the dirt boring head or the rock boring head to help secure the respective boring head to the shaft.

3. The auger of claim 2 wherein the opening comprises a flat portion for engaging a portion of the respective boring head to prevent the boring head from spinning independently from the shaft.

4. The auger of claim 1 wherein the drilling elements are combined with the attachment plate when the dirt boring head is combined with the shaft second end.

5. The auger of claim 4 wherein the attachment plate further comprises protrusions and recesses.

6. The auger of claim 1 wherein the attachment plate comprises protrusions and recesses for helping to secure the wear cap to the attachment plate.

7. The auger of claim 6 wherein the wear cap comprises protrusions and recesses for mating with the protrusions and recesses on the attachment plate to help secure the wear cap to the attachment plate.

8. The auger of claim 1 wherein the wear cap is combined with the attachment plate when the rock boring head is combined with the shaft second end.

9. The auger of claim 8 wherein the attachment plate comprises a top side and a bottom side; and wherein the wear cap covers and protects a portion of the attachment plate top side from abrasive spoils.

10. The auger of claim 9 wherein the wear cap is combined with the attachment plate by bolts.

11. The auger of claim 9 wherein the rock boring head fully covers and protects a portion of the attachment plate bottom side from abrasive spoils.

12. A method for changing an auger from having a dirt boring head for drilling through soft ground conditions to having a rock boring head for drilling through hard ground conditions, wherein the auger comprises a shaft having a first end adapted to combine with a drilling machine and a second end having an opening and an attachment plate with a top side and a bottom side, wherein the dirt boring head has a pilot bit removably combined with the opening and a plurality of generally flat drilling elements all independently removably combined with the attachment plate and the rock boring head is one integral member removably combined with the opening, said method comprising:

removing the pilot bit from the opening;

removing the generally flat drilling elements from the attachment plate;

inserting a portion of the rock boring head into the opening in the shaft second end and securing the rock boring head to the shaft so that the rock boring head covers the attachment plate bottom side; and securing a wear cap to the attachment plate top side so that the attachment plate is sandwiched between the wear cap and the rock boring head.

* * * * *